United States Patent [19]

Sanders

[11] Patent Number: 4,756,097

[45] Date of Patent: Jul. 12, 1988

[54] ADJUSTABLE HEEL PROTECTOR FOR LADIES SHOES

[76] Inventor: Clarence C. Sanders, P.O. Box 84127, Los Angeles, Calif. 90073

[21] Appl. No.: 85,562

[22] Filed: Aug. 17, 1987

[51] Int. Cl.[4] ..... A43B 23/30

[52] U.S. Cl. ..... 36/72 B; 36/72 R

[58] Field of Search ..... 36/72 B, 72 R, 7.1 R

[56] References Cited

U.S. PATENT DOCUMENTS

| | | | |
|---|---|---|---|
| 1,830,912 | 11/1931 | Ramey | 36/72 B |
| 1,916,815 | 7/1933 | Smith | 36/72 B |
| 1,955,159 | 4/1934 | Winget | 36/72 B |
| 3,063,172 | 11/1962 | Beattle | 36/72 B |
| 3,239,953 | 3/1966 | Norton | 36/72 B |
| 4,665,633 | 5/1987 | Edgerton | 36/7.1 R |

FOREIGN PATENT DOCUMENTS

| | | | |
|---|---|---|---|
| 623606 | 8/1961 | Italy | 36/72 B |
| 2171588 | 9/1986 | United Kingdom | 36/72 B |

*Primary Examiner*—Steven N. Meyers
*Attorney, Agent, or Firm*—Albert O. Cota

[57] ABSTRACT

An adjustable ladies shoe heel protector which has a body (20) of thermoplastic material in the shape of the heel portion of a shoe. Adjustment is provided by an overlapping joint (32) having pressure sensitive adhesive (34) that is formed and joined to match the exact configuration of a specific shoe. The height of a given heel is mated by trimming the heel portion to the appropriate length using performations (40) as a guide. An integral annealed metal tab (36) is bent over the counter of the shoe holding the protector in place while the user is driving a motor vehicle, thereby preventing scuffing of the shoe. The adjustment in size and convenience of attachment overcomes the problem heretofore encountered with heel protectors.

5 Claims, 1 Drawing Sheet

ADJUSTABLE HEEL PROTECTOR FOR LADIES SHOES

TECHNICAL FIELD

The present invention relates to covers for shoes in general and more specifically to a protector for a ladies shoe that is worn over the heel when driving a motor vehicle.

BACKGROUND ART

The problem of shoes being worn or scuffed by the floorboard of a motor vehicle has been encountered since the introduction of the modern automobile. Attempts to solve this problem date as far back as the mid 1920's, however, the prior art presented at that time had not been publicly accepted to any great extent. The basic problem stems from dirt and grit being carried into the vehicle on the bottom of the shoes and in time this material collects in the carpet, or pad, creating an extremely abrasive surface upon which the drivers foot must rest. Since the driver has no alternative but to maintain the foot position on alternately the accelerator or brake the movement, as well as the vibration of the vehicle compels the rear portion of the heel to abraid and wear. This is particularly true in leather shoes having a colored base coating, such as a womans high heel shoe. Prior art has attempted to solve this problem by utilizing a cover over the heel portion which does, indeed, protect the surface, but the approach requires special sizes and individual adjustment with straps or clips to hold the device in place. While this direction accomplishes the end result, no provisions have been made for any adjustment in size of the shoe or height of the heel.

A search of the prior art did not disclose any patents that read directly on the claims of the instant invention, however, the following U.S. patents were considered related:

| U.S. Pat. No. | Inventor | Issue Date |
|---|---|---|
| 1,620,401 | Smock | Mar. 8, 1927 |
| 2,998,830 | Zacks | Jun. 20, 1961 |
| 3,153,289 | Martin | Oct. 20, 1964 |
| 4,461,100 | Minor et al | Jul. 24, 1984 |

Smock approached the problem using a leather sheath the same approximate size as the outside of the shoe. An appropriate shape lift of wood or leather is attached to the bottom of the heel and a strap holds the device on the foot engaging the instep portion of the wearers foot. The heel is enclosed by a leather strip of material disposed on the open side or front of the device preventing rearward displacement with respect to the shoe.

Zacks, on the other hand, uses an envelope of laminated outer fabric and inner sponge plastic material with a marginal tape attached to the top continuing on around the instep of the wearers foot. Storage is provided by an envelope of similar material attached to the underside of an automobile dashboard for convenience.

Martin teaches an improved heel guard having a bottom pocket portion in which the lower section of the heel is confined and is open at the front above the pocket for fitting around the sides of the shoe and foot. The upper end of the heel guard has a form-retaining resilient clip of oval shape allowing a temporary widening for application or removal. The glove-like body is formed of a flexible material, such as cloth, plastic, or leather, with the oval spring clip sewn into the top section grasping the wearers ankle above the shoe.

Finally, Minor et al utilize a shield of leather, vinyl, or fabric, with a permanently attached band of rubber along each side edge for gripping onto the heel. A strap with Velcro loop pile strips circumvent the wearers ankle above the shoe to attach to the wearers foot. No adjustment is made, as the rubber compensates for the width of the heel, however, the top is dependent upon the ankle for attachment. For low heeled shoes, an entirely different approach is taken with the protector not enclosing the heel at all and a strapping device extending under the foot arch and over the wearers instep.

It is apparent from the prior art thus recognized that each device is made to fit a particular size shoe and foot with the recognization of the problem of different sizes of shoes still unanswered.

DISCLOSURE OF THE INVENTION

The adjustable heel protector has a primary object to provide a single heel protector that will fit all types and styles of ladies shoes having low, medium, or high heels, without respect for form or size. This is achieved by the use of a novel wrapper type body that is adjustable in size to fit the particular heel by simply wrapping around the shoe and maintaining the form with pressure sensitive adhesive on the closure. In the advent of extremely small shoes, the excess material is simply and easily cut away. This invention is, therefore, universal in configuration and is shaped manually once and is then custom fit for the particular shoe.

An important object of the invention is in the adjustment in height of the rear counter portion. This adjustment is accomplished by the use of an annealed metal tab covered with a resilient plastic material that is bent over the upper counter of the shoe. As each shoe size and style differs somewhat in the height of the counter, the tab easily accommodates the variation by the point at which the tab is bent over. The minimum height of the protector is established by the height of the smallest shoe, and the tab length is determined by the largest size normally encountered, therefore, anything in between is easily facilitated.

The method of modifying the height of the heel also becomes another important object in that perforations are provided for tearing the material at the closest height desired. If scissors are available, the protector may be cut to the exact height, however, to further the ease of adjustment, the extending heel length may be torn away by hand at the perforations. Even cutting by the use of a knife is made easier using the prealigned marking of the perforations.

Still another object of the invention provides a disposable feature for the protector, in that the major portion of the invention is fabricated of a cost effective thermoplastic material. This object allows the protector to be used on one or more shoes and then discarded, as the cost is such that prolonged use until it is worn out is unnecessary. Further, different height heels requiring different protectors may be maintained at a cost that is not prohibitive.

Yet another object of the invention is the simplicity of adjustment and use. The shape and attaching elements are easy to understand and the entire protector is obvious in its function and method of attachment.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
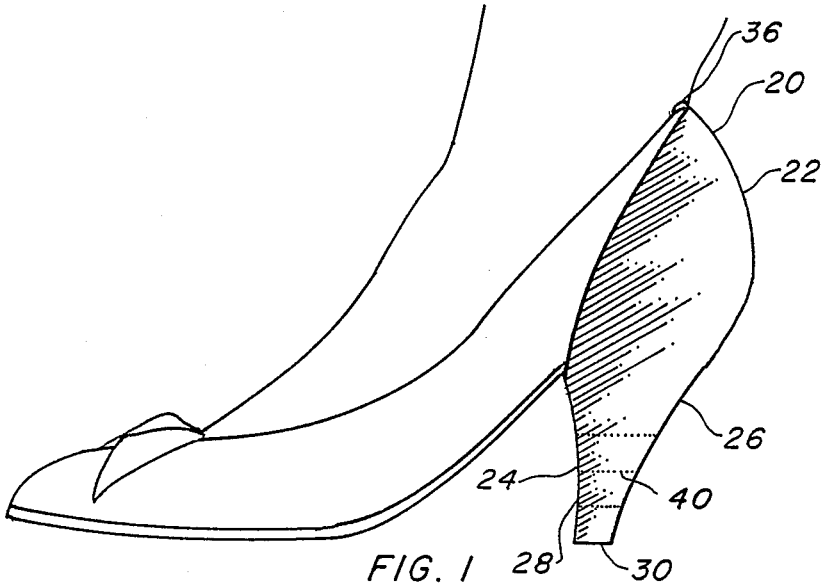
FIG. 1 is a side elevation view of the preferred embodiment attached to a ladies high heeled shoe.
Figure 2:
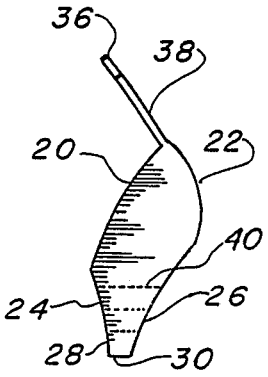
FIG. 2 is a side elevational view of the heel protector removed from the shoe with the attaching tab unbent.
Figure 3:
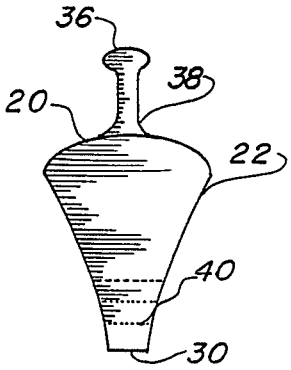
FIG. 3 is a rear elevational view of the heel protector removed from the shoe with the attaching tab unbent.

The best mode for carrying out the invention is presented in terms of a preferred embodiment. The preferred embodiment, as shown in FIGS. 1 through 6, is comprised of a body 20 that basically conforms to the rear heel area of a ladies shoe. The body upper portion 22 is arcuate at the top and convex is shape and is juxtaposed over the shoe counter. This shape is based on an overall height of a small sized shoe with the amount of convex shape based on a combination of average sizes of a spectrum from small to large. The lower part of the heel protector is formed in the shape of the heel with the front heel portion 24 so configured as to be completely adjustable. The rear heel portion 26 is convexly elongated with a radial shape tapering from the upper portion 22 to the bottom of the heel area at least the size of the largest shoe heel. The front heel portion 24 further contains a pair of angular corners 28 that give the protector the basic shape of the entire heel area of a shoe. The bottom 30 of the heel area, which comprises basically of the front 24 and rear 26 portions, is open exposing the shoe, which is normally in contact with the walking surface. This configuration, as it will be seen in the drawings, covers the shoe back counter area and encloses the heel, except at the bottom, providing a protective cover for the shoe in the region that rests on the floorboard of a motor vehicle, when in the driving position.

The entire body 20 is constructed of a resilient formable material, such as thermoplastic. This may be of any suitable substance, such as styrene, polypropylene, polyethylenes, or cellulose acetate butyrate, and the like. It will be noted that the invention is not limited to the materials suggested above, but may include other thermoplastic substances, as well as leather, laminated fabric, metal, etc.

In order to accommodate different sizes of heels on the shoes, the front heel portion 24 of the body 20 contains an overlapping joint 32. This joint 32 is formed with two parallel surfaces mating on the front heel area 24 in juxtaposition one on top of the other. The adjustment is accomplished by the degree of overlap present in the joint 32. Not only is the internal size expanded or reduced, but the taper may be altered to fit exactly the configuration of the heel.

In order to make the joint 32 relatively permanent, pressure sensitive adhesive 34 is applied to one or both sides of the mating surfaces. This adhesive may be in the form of tape with both sides adherably applied by pressure to the protector front 24 with a nonsticking peelable cover for application by the user. The adhesive may also be sprayed, or otherwise applied to the surface with equal ease. In any event, the pressure sensitive adhesive 34 creates the bond with the overlapping ends and any excess material may be trimmed away with scissors or a knife, leaving the heel section the desired shape and size.

In order to make the length of the protector fit the particular heel style and dimension, the distance is controlled by a tab of annealed metal 36 that is joined to the upper portion 22 of the body 20. The tab 36 is attached permanently by molding integrally with the body 20 or installed by fastening means well known in the art, such as rivets, staples, grommets, and the like. The tab 36 is formed in a narrow, relatively thin shape with an enlarged end on the extending segment. This configuration is best illustrated straight in FIGS. 2 through 4 and bent over in FIGS. 5 and 6. When the protector is installed on the shoe, the tab 36 is folded downward forming a hook over the counter holding the protector in place in clamplike fashion. As the tab 36 is annealed, the metal is softened and will not break with constant usage of folding and unfolding into the hook shape. In order to protect the users nylon hose from possible sharp edges on the tab 36, a coating 36 of resilient thermoplastic material completely covers the exposed surface. This coating 38 may be added after the tab 36 is attached to the body 20, or may be formed integrally with the body during the initial manufacturing process. The coating 38 does not interfere with the function of the tab 36 and adds some possible asthenic value to the invention.

In order to aid in the initial adjusting and triming to length of the invention for the proper height of the heel, a series of horizontal perforations 40 are utilized in a linear direction around the periphery of the heel. The location of the perforations 40 correspond to the height of a conventional low, medium, or high heel of a ladies shoe. The perforations 40 allow the protector to be cut, or torn, to the corresponding height of the heel upon which the protector is utilized.

Figure 4:
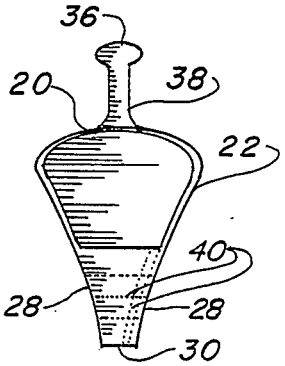
FIG. 4 is a front elevational view of the heel protector removed from the shoe with the attaching tab unbent and the heel partially cut away for clarity.
Figure 5:
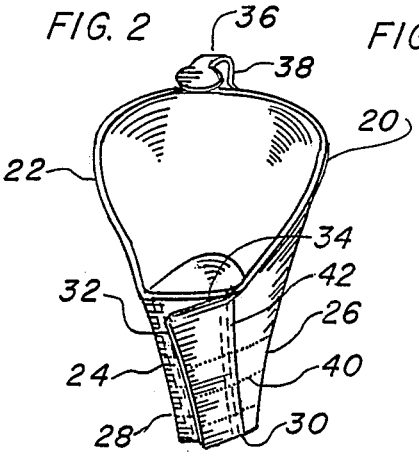
FIG. 5 is a partial isometric view of the preferred embodiment with the body opened prior to adjustment and the tab bent in the attachment position.
Figure 6:
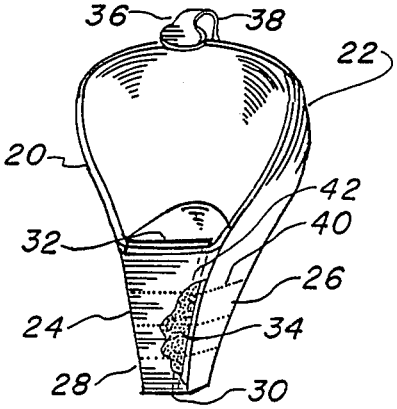
FIG. 6 is a partial isometric view of the preferred embodiment with the tab bent in the attaching position.

Another aid to the initial sizing of the protector is another series of vertical perforations 40 in parallel linear fashion on the front heel portion of the heel protector. These perforations 40 are shown in FIGS. 4 and 5 and allow the body front heel portion 24 to be folded or bent into the exact shape of the heel. The perforations 40 allow the selected bend to follow the closest heel contour. Equally suited in place of perforations 40 are a series of parallel indentations 42 that serve the same purpose but do not penetrate the body 20 itself. These indentations 42 are pictorially illustrated in FIGS. 5 and 6.

It will be noted that the adjustable heel protector, being made of plastic, may in any color desired in opaque, or translucent material. In yet another material, the body may be clear, allowing the shoe color to be duplicated or seen through the body 20 itself.

While the invention has been described in complete detail and pictorially shown in the accompanying drawings, it is not to be limited to such details, since many changes and modifications may be made in the invention without departing from the spirit and the scope thereof. Hence, it is described to cover any and all modifications and forms which may come within the language and scope of the appended claims.

I claim:

1. An adjustable heel protector for ladies shoes to be used while driving a motorized vehicle comprising;

(a) a body having an upper, as well as a front and rear heel portion, composed of relatively resilient material characterized by a shape conforming to a ladies shoe with the upper portion juxtapositioned over the shoe counter and the heel portions completely enclosing the outside of the shoe heel with the exception of the bottom which is in contact with the surface normally walked upon said body so configured as to define mating overlapping contiguous surfaces on the front heel portion nearest to the front of a shoe allowing the body to be adjusted in size over the heel by the amount of overlap present, the entire body formed in a tapered radial shape with the upper portion convexly elongated and angular corners on the front heel portion, (b) a tab of annealed metal affixed permanently to the upper portion of said body and configured in such a manner as to be folded downward to define a hook over the counter of ones shoe holding the protector in place upon the shoe when worn, facilitating attachment with the heel portion of the shoe where the tab located on the upper portion of the protector grips the shoe in a clamplike fashion therebetween, and, (c) pressure sensitive adhesive disposed on the mating overlapping surfaces of said front heel portion allowing the shape of the protector to conform exactly to the configuration of the heel of the shoe upon which it embraces by attaching the overlapping surfaces in a permanent fashion after over the heel forming has been accomplished using the shoe as a pattern.

2. The adjustable heel protector for ladies shoes as recited in claim 1 further comprising, said heel portions having a series of horizontal perforations in parallel linear fashion around the periphery of a location corresponding to a low, medium and high heel of said ladies shoe allowing the protector to be cut, or torn, to the corresponding height of the heel upon which the protector is utilized.

3. The adjustable heel protector for ladies shoes as recited in claim 1 further comprising, said front heel portion having a series of vertical perforations in parallel linear fashion on said front heel portion corresponding to the width of said heel upon which the protector is utilized allowing the protector to be bent to the equivalent size surrounding the heel.

4. The adjustable heel protector for ladies shoes as recited in claim 1 further comprising, a coating of resilient thermoplastic material covering said tab of annealed metal, such that the tab does not scuff or abraid said shoe when folded downward when defining a hook over the counter thereof.

5. The adjustable heel protector for ladies shoes as recited in claim 1 further comprising, said front heel portion having a series of parallel indentations in parallel linear fashion as said front heel portion corresponding to the width of said heel upon which the protector is utilized allowing the protector to be bent to the equivalent size surrounding the heel.

* * * * *